US006836213B1

(12) United States Patent
Perry

(10) Patent No.: US 6,836,213 B1
(45) Date of Patent: Dec. 28, 2004

(54) METHOD AND APPARATUS FOR IMPROVING THE SENSITIVITY OF A TAUT WIRE INTRUSION DETECTION SYSTEM

(75) Inventor: Haim Perry, Emerson, NJ (US)

(73) Assignee: Safeguards Technology, Inc., Hackensack, NJ (US)

( * ) Notice: Subject to any disclaimer, the term of this patent is extended or adjusted under 35 U.S.C. 154(b) by 0 days.

(21) Appl. No.: 09/340,914

(22) Filed: Jun. 28, 1999

(51) Int. Cl.[7] ..... G08B 13/26

(52) U.S. Cl. ..... 340/564; 340/541; 340/668; 256/2; 256/10

(58) Field of Search ..... 340/564, 541, 340/540, 561, 668, 644; 256/2, 10, 7

(56) References Cited

U.S. PATENT DOCUMENTS 4,155,083 A * 5/1979 Slaats et al. ..... 340/666
4,367,459 A * 1/1983 Amir et al. ..... 340/541
4,500,873 A * 2/1985 Porat et al. ..... 340/515
4,527,150 A * 7/1985 Porat ..... 340/541
4,730,809 A * 3/1988 Stoler ..... 340/668
4,829,287 A * 5/1989 Kerr et al. ..... 340/541
5,063,288 A 11/1991 Hsu et al.
5,103,207 A * 4/1992 Kerr et al. ..... 340/541
5,371,488 A * 12/1994 Couch et al. ..... 340/541
5,434,557 A * 7/1995 Alizi ..... 340/555
5,438,316 A * 8/1995 Motsinger et al. ..... 340/541
5,461,364 A * 10/1995 Sanford et al. ..... 340/541
5,852,402 A * 12/1998 Perry ..... 340/541

* cited by examiner

*Primary Examiner*—Nina Tong
(74) *Attorney, Agent, or Firm*—Skadden, Arps, Slate, Meagher & Flom LLP

(57) ABSTRACT

A taut wire intrusion detection system includes posts that are used to detect an intrusion into a secured area. The supporting posts are used to both detect a movement of the taut wire and anchor the taut wire by using separate anchor and sensor elements. The taut wire system eliminates many of the weaknesses of prior taut wire systems by providing a less variant taut wire sensitivity.

12 Claims, 7 Drawing Sheets

METHOD AND APPARATUS FOR IMPROVING THE SENSITIVITY OF A TAUT WIRE INTRUSION DETECTION SYSTEM

BACKGROUND OF THE INVENTION

This invention relates to intrusion detection systems of the type which use taut wires to form a physical barrier, and which use tension sensors coupled to the taut wires to detect attempts to defeat the physical barrier.

DESCRIPTION OF THE RELATED ART

A variety of intrusion detection systems are known, ranging from those protecting private residences to those protecting large-scale, relatively high security, facilities such as airports and military installations. A number of the systems of the second kind, those protecting large-scale facilities, typically provide a combination of a physical barrier and an electronic detection capability. A taut wire intrusion detection system provides such a combination. Such a system is available, for example, from Safeguards Technology of Hackensack, N.J.

A typical taut wire intrusion detection system will include sensors, sensor posts, taut wires, anchor posts, and slider posts. A single or several sensors will usually be mounted on a post, typically referred to as the "sensor post." Taut wires, commonly formed from a double strand steel barbed wire, are attached to the single sensor or group of sensors mounted on the sensor post. Each taut wire segment usually terminates at two anchor posts placed on opposite sides of the sensor post to form a subsection of the intrusion detection system. Spiral shaped steel rods typically referred to as "slider posts," are sometimes placed vertically between the taut wires as to prevent the wires from bowing or sinking down. Each taut wire is maintained in tension between the anchor posts such that the sensor will detect a cut or deflection of the taut wire, triggering an alarm at a control center. Multiple subsections constructed in this manner are linked together to secure a given area.

The threshold distance taut wire segments are required to be displaced (displacement requirement) in a typical taut wire system, whereby the sensor or sensors of the sector can detect an intrusion attempt, varies along the length of the sector such that certain areas of the taut wire fence are more vulnerable to intrusion attempts than others. The level of force (force requirement) that must be applied to the taut wire segments to trigger an alarm condition also varies along the length of the sector because the anchor post is an anchoring element that is not sensitive to intrusion attempts. Combined together, the displacement requirement and the force requirement can be perceived as the sensitivity of the taut wire system, such that the sensitivity level is inversely proportional to both requirements. The method and system of the present invention provide an increased uniformity of sensitivity for taut wire intrusion detection systems.

SUMMARY OF THE INVENTION

The method of the present invention results in a lower sensitivity variance in a section of the system by using supporting posts that include both sensor and anchor elements. The supporting posts are arranged such that each post contains both sensor and anchor elements. The sensitivity can be made to have a very low variance by adapting the arrangement of sensors and anchor elements to the particular variance exhibited by the taut wire segments of the system.

The present method provides a more reliable system which has uniform sensitivity over the secured sections. The present invention allows for a more precise identification of an intrusion location by eliminating the sector method of constructing intrusion detection systems. The method of the present invention employs a section paradigm as opposed to a sector paradigm since each portion of a system of the present invention includes a variable number of posts.

The present invention also provides a taut wire intrusion detection system that has a first support post which includes at least one taut wire anchor element and at least one taut wire sensor. The system has a second support post which includes at least one taut wire anchor element and at least one taut wire sensor. A first taut wire segment extends under tension between the first and second support posts. The first taut wire segment is anchored to the first supporting post by an anchor element and is coupled to a taut wire sensor of the second support post. A second taut wire segment extends under tension between the first and second support posts such that the first and second taut wire segments are vertically separated from one another. The second taut wire segment is anchored to the second supporting post by an anchor element and is coupled to a taut wire sensor of the first support post.

The present invention additionally provides for an increase in the accuracy of identifying the intrusion location when an alarm condition is sensed by the sensors on the supporting posts. The present invention additionally eliminates the need to use special anchoring elements to account for the weaknesses of a system near the anchor posts.

BRIEF DESCRIPTION OF THE DRAWINGS

The foregoing features and other features of the present invention will now be described with reference to the drawings of a preferred embodiment of a taut wire intrusion detection system. In the drawings, the same components have the same reference numerals. The illustrated embodiment is intended to illustrate, but not to limit the invention. The drawings include the following figures.

DETAILED DESCRIPTION OF THE PREFERRED EMBODIMENT

To facilitate an understanding of the preferred embodiment, the general architecture and operation of a conventional taut wire intrusion detection system will initially be described with reference to FIG. 1. The specific architecture and operation of the supporting post arrangement of a preferred embodiment will then be described with reference to the general architecture and operation of a taut wire intrusion detection system.

Figure 1:
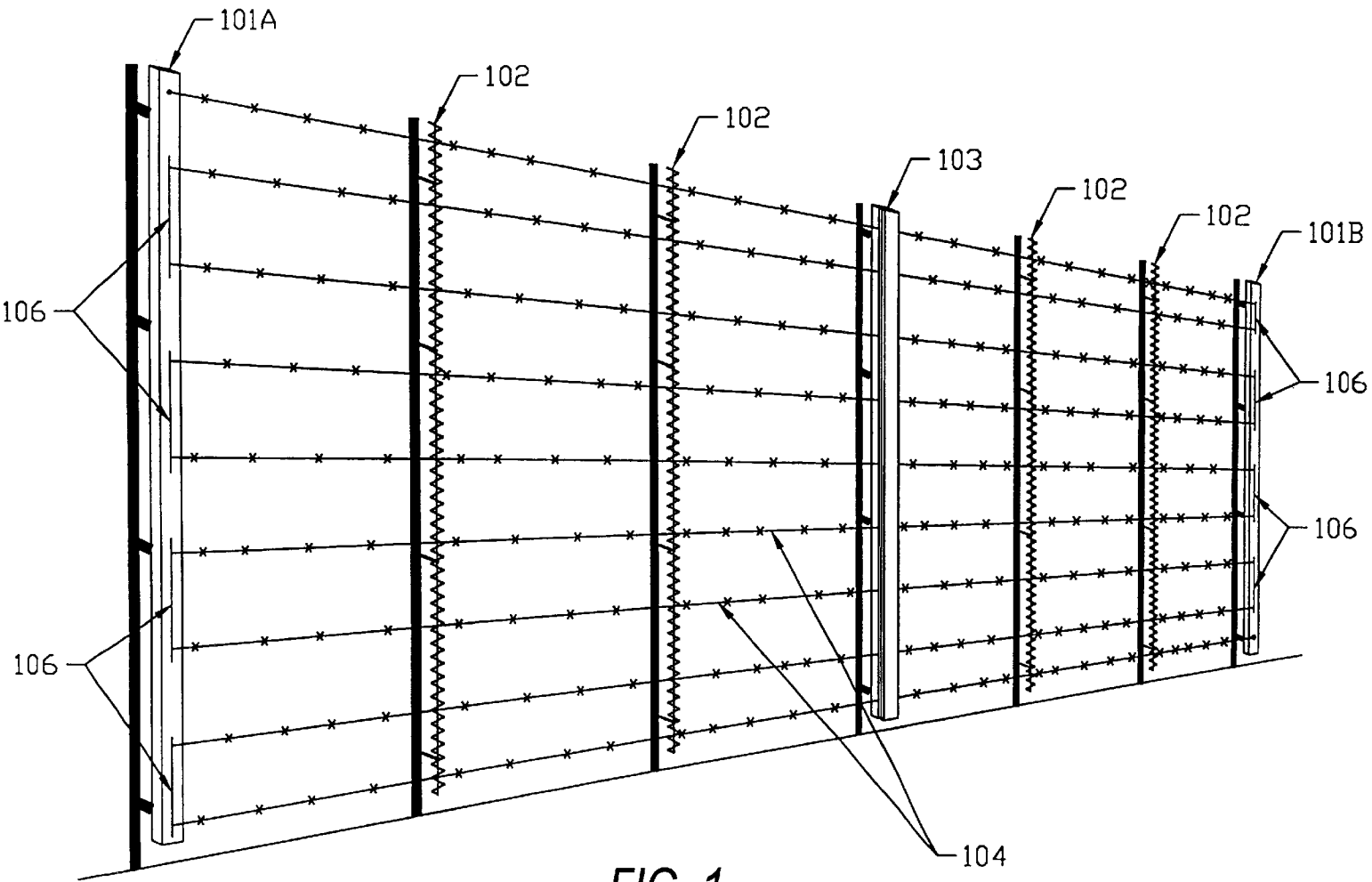
FIG. 1 PRIOR ART
FIG. 1 illustrates one configuration of a typical taut wire intrusion detection system.

Referring now to FIG. 1, which illustrates one section of a prior art taut wire intrusion detection system, two anchor posts 101A and 101B are mounted at opposite ends of the section. Multiple taut wires 104, which may be in the form of barbed wires, are attached to and held under tension by the anchor posts 101. A sensor post 103 is mounted at the center of the section between the two anchor posts 101. The sensor post contains tension sensors (not shown) that are used to monitor the tensions of the taut wires 104. Such sensor posts and anchor posts are available from Safeguards Technology of Hackensack, N.J. The taut wires 104 are connected to tension sensors in the sensor post 103. Slider posts 102, positioned between an anchor post 101 and the sensor post 103, are placed adjacent to the taut wires 104 to provide additional vertical support as to prevent a bowing of the taut wires 104. The slider posts 102 also serve as a mechanism to convert vertical and horizontal force exerted on the taut wires into longitudinal movement. The taut wires 104 are secured to the anchor post 101 by link rods 106.

Figure 2:
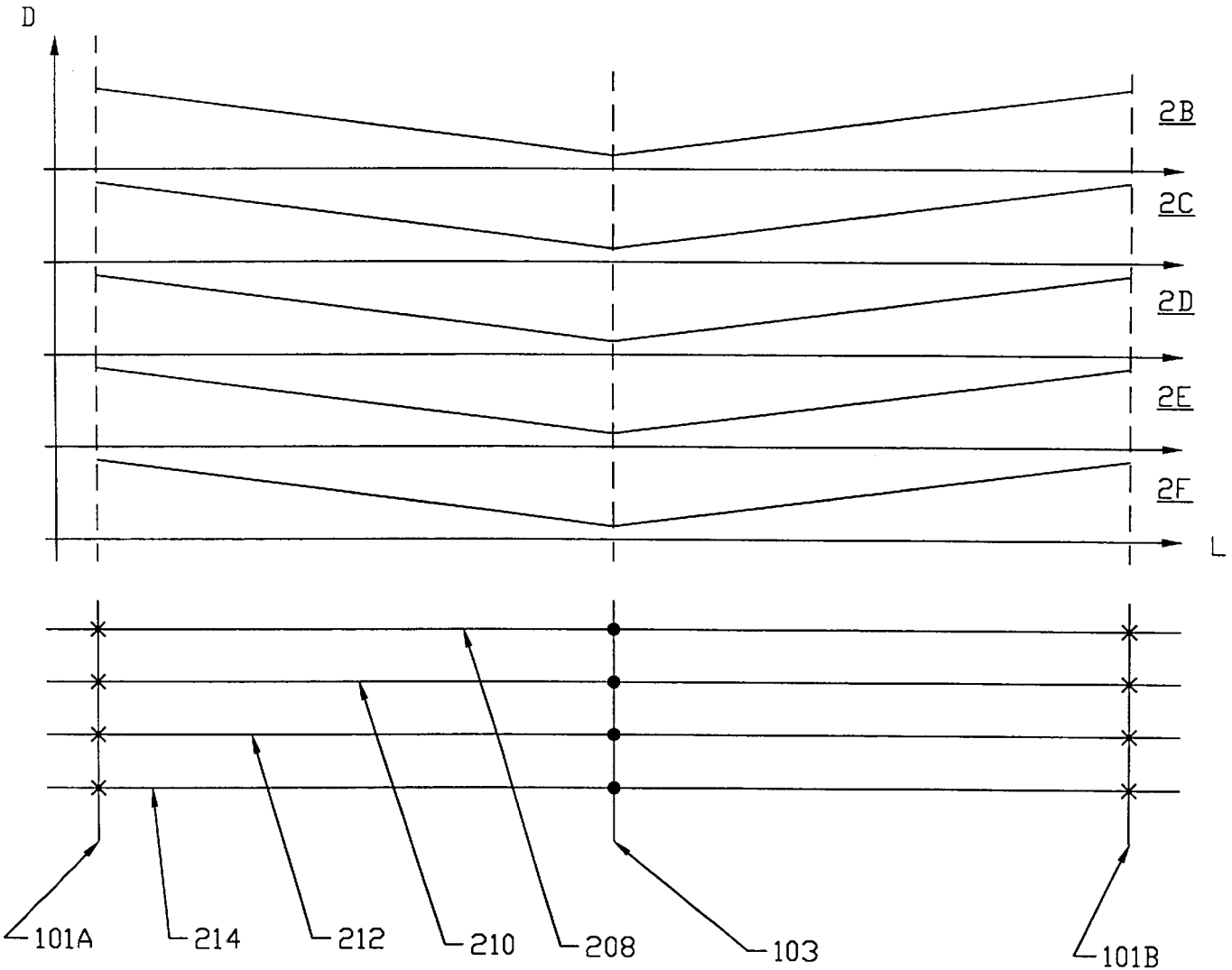
FIGS. 2A–2F illustrate the displacement requirement of a section of a typical taut wire intrusion detection system.

The displacement requirement of a sector in the prior art taut wire systems is not uniform over the distance from one anchor post to the other. Rather, the displacement requirement of a prior art taut wire system such as that of FIG. 1 is location dependent, as can be appreciated from FIGS. 2A–2F. FIG. 2A is a simplified diagram of a taut wire system including a pair of anchor posts 101A, 101B, a sensor post 103, and four taut wire segments 208, 210, 212, 214. The taut wire segments are monitored by sensors (not shown) on the sensor post 103. FIG. 2B illustrates the displacement requirement of taut wire segment 208 over the distance between a first anchor post 101A and a second anchor post 101B. As may be appreciated, the displacement requirement of the taut wire segment is at a maximum (resulting in minimum sensitivity) near the first anchor post 101A. The displacement requirement of the taut wire segment 208 decreases as the contact point approaches the sensor post 103. The displacement requirement is at a minimum (resulting in maximum sensitivity) near the sensor post 103. The displacement requirement of the taut wire segment 208 increases as the contact point moves toward the second anchor post 101B. The displacement requirement is again at a maximum near the second anchor post 101B.

The variance in displacement requirement is mainly due to the elasticity of the wound steel strand or barbed wire making up the taut wire. As the point of contact moves away from the sensor, more taut wire is available between the contact point and the sensor. The increase in taut wire length results in a greater proportion of the taut wire displacement resulting in an elongation of the taut wire as opposed to a displacement of the sensor taut wire connector element.

FIGS. 2C–2E represent the similar displacement requirement exhibited by the other taut wire segments 210, 212, 214, along the distance from the first anchor post 101A to the second anchor post 101B. FIG. 2F is an illustration of the average displacement requirement of the taut wire sector, which is calculated by combining the displacement requirements of the taut wire segments and dividing by the number of taut wire segments.

The force requirement of a sector in a typical taut wire system likewise is not uniform along the distance from one anchor post to another. Rather, the threshold force, which must be applied to the taut wires in a sector of a typical taut wire system, increases as the contact point moves towards the anchor posts, as can be appreciated from FIGS. 3A–3F. FIG. 3A is a simplified diagram of a taut wire system as was illustrated in FIG. 2A. FIG. 3B illustrates the force requirement of one of the taut wire segments 208 along the distance between a first anchor post 101A and a second anchor post 101B. As may be appreciated, the force requirement of the taut wire segment is at a maximum (resulting in minimum sensitivity) near the first anchor post 101A, demonstrated by the higher level of force that must be applied to the taut wire at the location. The force requirement of the taut wire segment 208 decreases as the contact point approached the sensor post 103, demonstrated by the lower level of force that must be applied to the taut wire near the sensor post. The force requirement is at a minimum (resulting in maximum sensitivity) near the sensor post 103. The force requirement of the taut wire segment 208 then increases as the contact point moves toward the second anchor post 101B.

The variance in force requirement is the result of the increase in displacement distance required and the decrease in distance from the fixed anchor connection. Since the displacement requirement of the taut wire increases as the contact point approaches the anchor posts, the force required also increases since the taut wire acts as a spring such that the force exerted by the taut wire increases as the wire is stretched. Also, in order to move the sensor taut wire attachment the taut wire portion on the anchor side of the contact point must also move. Since the anchor side of the contact point is fixed in position, the only movement that is possible is the stretching of the taut wire as opposed to a displacement of the anchor element. As the contact point nears the anchor element, less taut wire is available on the anchor side of the contact point. The force required to stretch a segment of taut wire increases as the length of the segment decreases. Therefore, as the contact point moves closer to the anchor post, the force requirement increases. As the point of contact moves away from the anchor post, more taut wire is available between the contact point and the anchor post to provide a longer segment of taut wire to stretch, timely reducing the force requirement. Additionally, some increase in force results from the increase in friction between the taut wire and the slider posts between the contact point and the sensor post. As the contact point moves away from the sensor post, more slider posts are between the contact point and the sensor, where the taut wire is displaced. Therefore, a greater area of the taut wire is in contact with slider posts and a greater friction force is applied to the taut wire when the contact point moves away from the sensor post.

FIGS. 3C–3E represent the similar force requirement exhibited by the other taut wire segments 210, 212, 214, over the distance between the first anchor post 101A and the second anchor post 101B. FIG. 3F is an illustration of the force requirement of the taut wire sector, which is calculated by combining the displacement requirement of the taut wire segments and dividing by the number of taut wire segments.

Because the force requirement increases as the contact point moves toward the anchor posts, greater force can be applied to the taut wires near the anchor posts without producing an alarm condition. As a result, with a very long sector, the force requirement may be high enough so as to support the weight of an intruder, allowing intruders to use the taut wires to step over the fence near the anchor posts. Therefore, the length of the taut wire sectors is limited by the level of increase in force requirement near the anchor posts. Additionally, for a given combination of sensors, taut wire material, and taut wire tension, there will always be a sector length for which the average displacement requirement of taut wires is too great for a reasonably secure system. At this distance, the taut wires near the anchor posts can be displaced far enough as to allow an intruder to pass through the fence. Some attempts to address these weakness have included using anchoring elements that break when vertical force above a certain threshold is applied, or using vertical force sensors as the anchor elements. These attempted solutions increase the cost of a system and require additional maintenance because more components that require service are introduced to the system. Even with these attempted solutions, sectors of the more effective taut wire intrusion detection systems, such as the system of FIG. 1, which employs breaking anchor elements, can generally only extend up to approximately 200 feet in length. Beyond the approximate maximum length, the increase in force requirement and increase in displacement requirement are too great for a reliable system. Increasing the overall sensitivity of the sensor posts of the system does not solve the problem as the rate of false alarms increases because the taut wire is very sensitive near the sensor posts.

FIGS. 4A–4B is an illustration of four sections taut wire system constructed in accordance with the present invention. The term section is used herein to refer to a portion of the taut wire system that includes a variable number of supporting posts and a pair of anchor posts. Anchor posts (represented by the character A) are provided at the ends of each section so as to provide a termination function for the supporting posts adjacent to the anchor post because some of the elements on the supporting posts are sensors. The anchor posts 401, 408, are preferably positioned outside the secured area, as shown, such that the sensitivity of the taut wire segments extending to the anchor posts does not affect the performance of the system. The supporting posts 402, 404, 406, 407, are provided between the anchor posts 401, 408, along intervals generally occupied in prior systems by both anchor and sensor posts. In another embodiment, the supporting posts are provided outside the secured area, before the anchor post.

Figure 4:
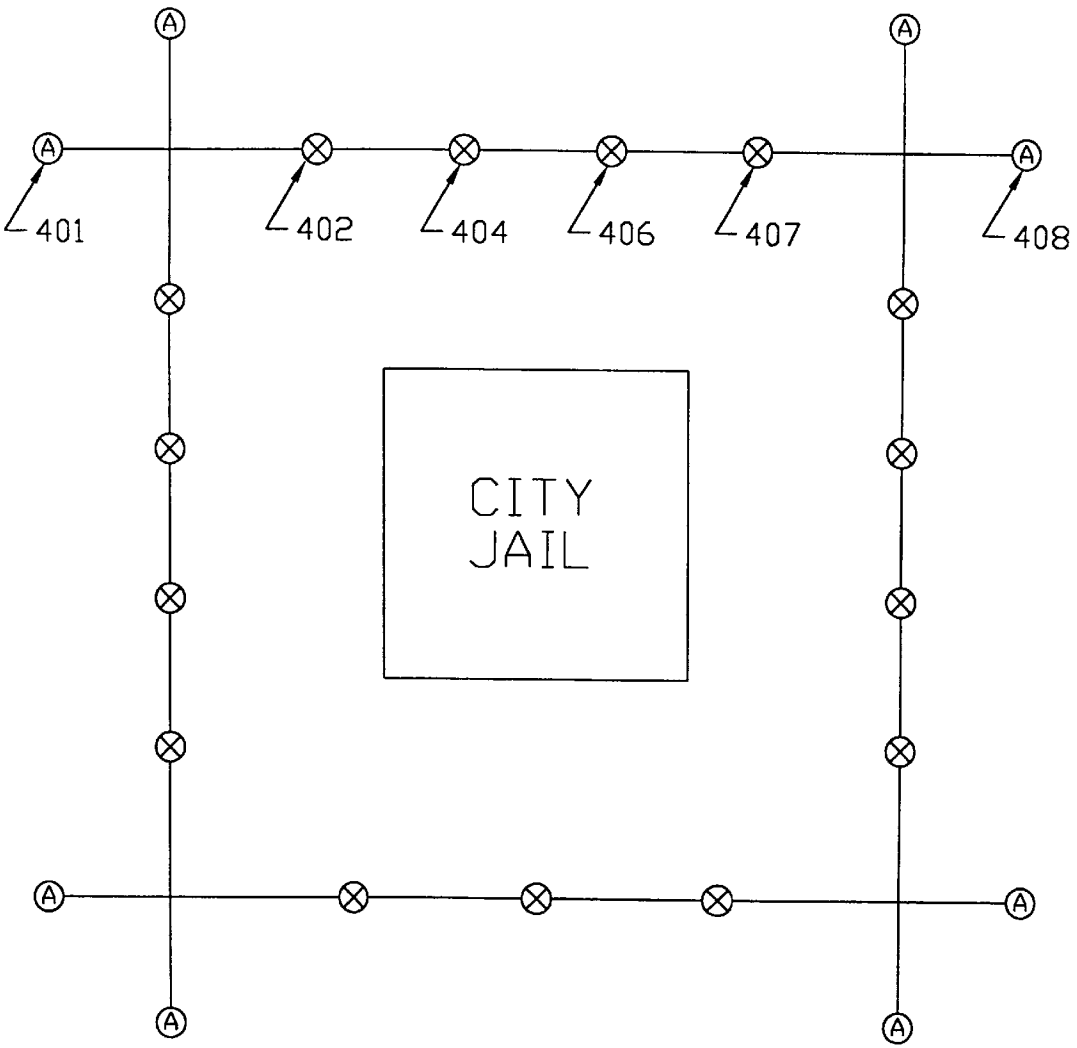
FIGS. 4A–4B illustrates a layout of a system that includes the supporting posts of the present invention.
Figure 5:
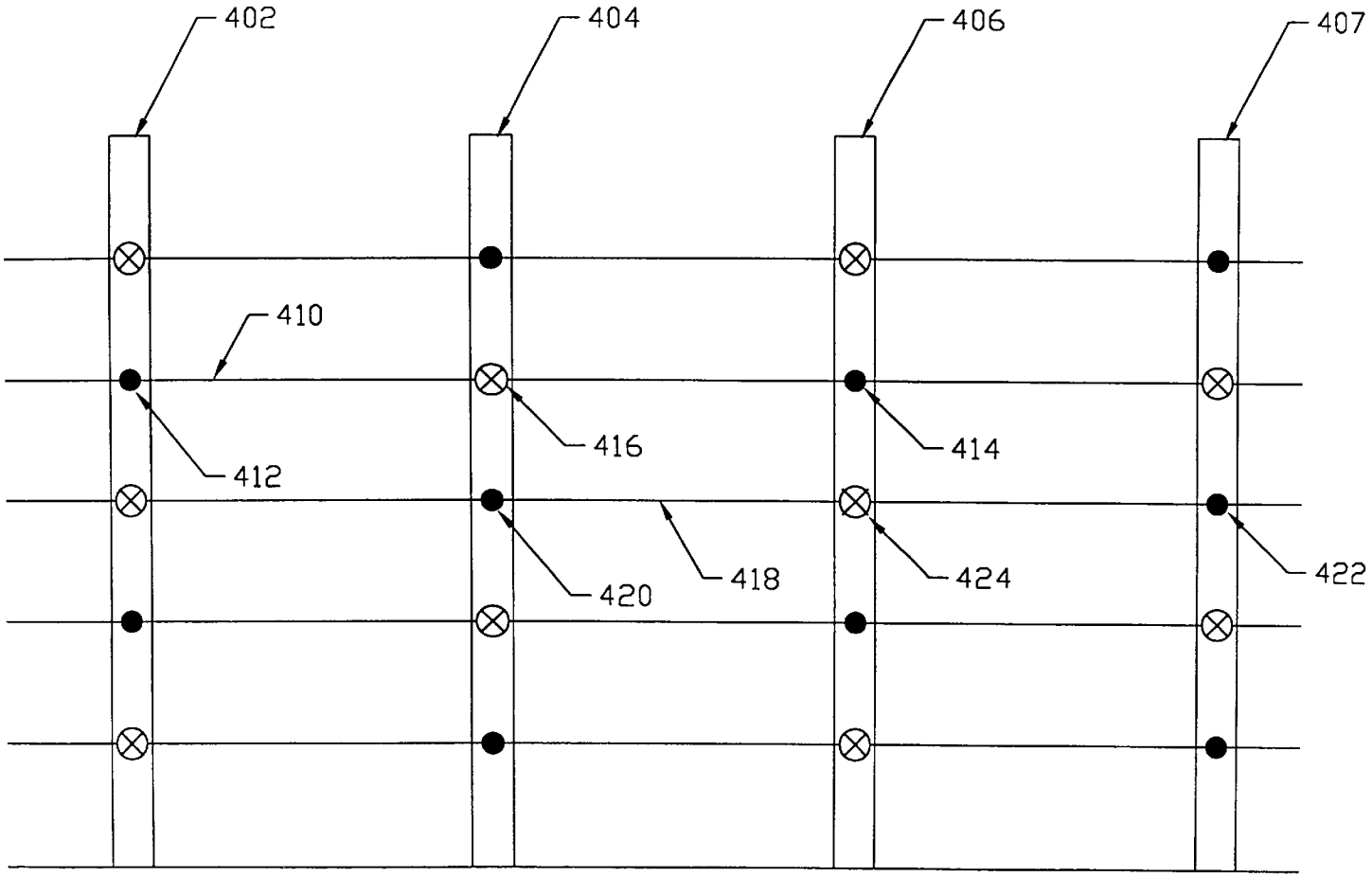
FIG. 5 illustrates a section of a system that includes the supporting posts of the present invention.

FIG. 5 is an illustration of a portion of the system of FIG. 4 that includes four supporting posts 402, 404, 406, 407. The supporting posts 402, 404, 406, 407, preferably contain, in an alternating arrangement, sensors and anchor elements. Taut wire segments terminate at the anchor elements on every other supporting post as can be seen from a first taut wire segment 410 of the system. The taut wire segment 410 is anchored by a first anchor element 412 on a first supporting post 402 and a second anchor element 414 on a third supporting post 406. The taut wire segment 410 is monitored by a sensor 416 on a second supporting post 404. Each sensor of the illustrated embodiment monitors a single taut wire although sensors that monitor more than one taut wire can be used.

As a second example, a second taut wire segment 418 is anchored by a first anchor element 420 on the second supporting post 404 and a second anchor element 422 on a fourth supporting post 407. The taut wire segment 418 is monitored by a sensor 424 on the third supporting post 406. Other taut wire segments are either monitored by sensors on adjacent supporting posts or kept in tension by anchor elements on adjacent supporting posts.

Conventional anchor elements, posts, and sensors can be used to provide the configuration illustrated by FIG. 5. For example, the breakable anchor elements used to prevent intruders from climbing the fence by using the anchor elements on the anchor posts of a typical taut wire system can be used as the anchor elements in the section illustrated in FIG. 5. Alternatively, the anchor elements may be extruded cylinders whereby the taut wire is wrapped around the inner cylindrical portion of the anchor elements and is locked in place by a cover that is attached to the base of the cylinder. By using cylindrical anchoring elements a single segment of taut wire can extend between several anchor elements. The sensors of FIG. 5 may be electromechanical taut wire sensors such as those available from Safeguards Technology, of Hackensack N.J. The sensors may also be sensors that employ fiber optics or Piezo-electric detection elements.

Sectors of typical taut wire intrusion systems, such as that of FIG. 1, can extend as much as 200 feet in length between a first anchor post and a second anchor post. When an alarm condition is communicated from a sensor to a control center, the entire sector, from the first anchor post to the second anchor post, must be manually inspected to isolate the cause of the alarm. Therefore, the scope of detection in such prior systems is the distance between three posts of the system, two anchor posts and one sensor post. In the system illustrated in FIG. 3, the scope of detection is likely to be two posts of the system, or about one half the distance for the reasons set forth below.

Figure 3:
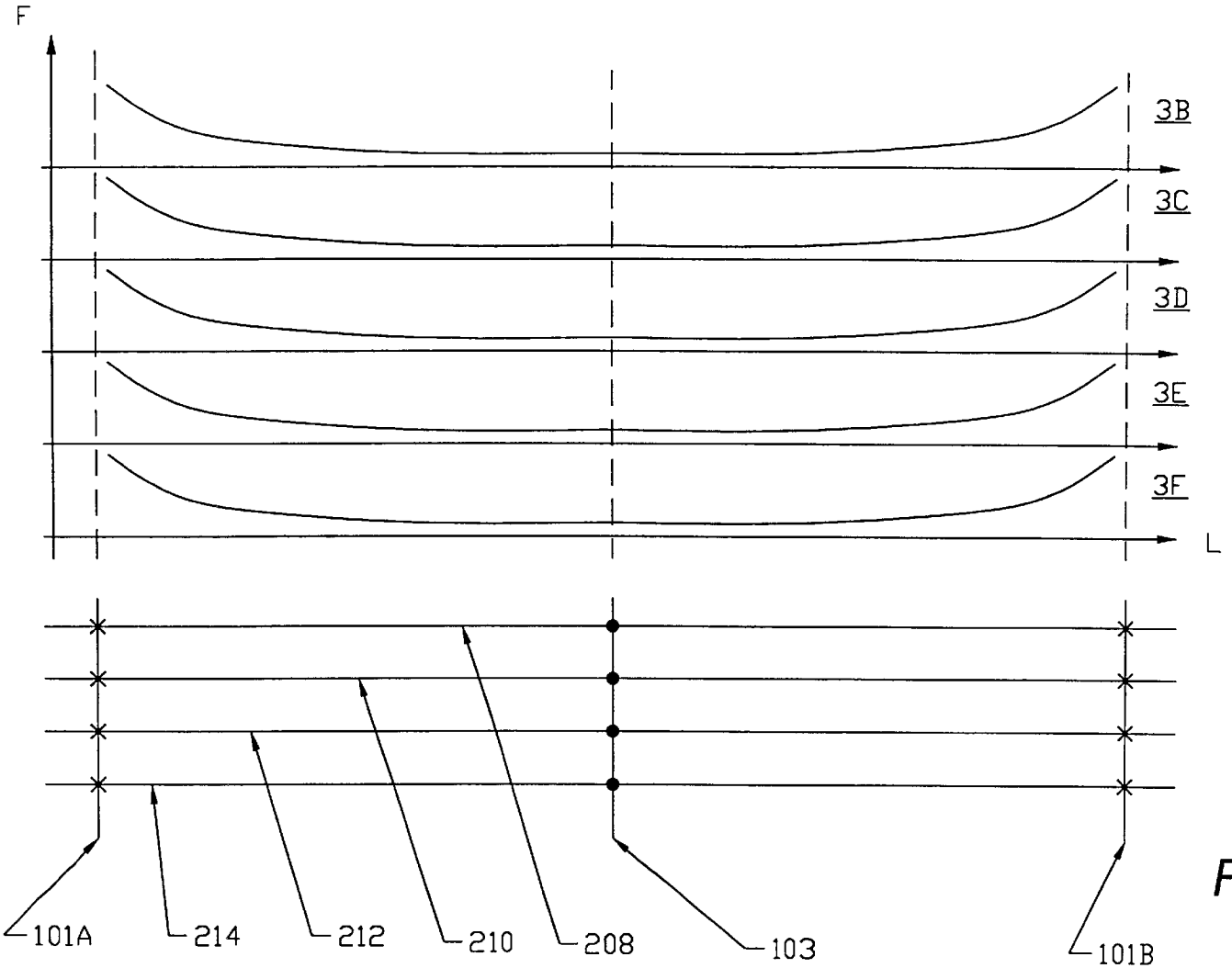
FIGS. 3A–3F illustrate the force requirement of a section of a typical taut wire intrusion detection system.

When an intruder attempts to bypass the taut wire system either by climbing over the fence or cutting through the fence, at least two taut wire segments will likely be engaged. The system of FIG. 3 is assumed to be implemented as a one wire per sensor system although the discussion below is equally applicable to multiple wire per sensor configurations. First, when an intruder climbs over the fence, it is highly likely that the intruder exerts force on at least two taut wires segments since the fence cannot generally be scaled in a single step. Second, when an intruder cuts through the fence, the intruder is likely to cut at least two adjacent taut wire segments because the distance between adjacent taut wire segments is generally too small for an intruder to fit through twice that distance.

When supporting posts are provided, in a configuration such as that of FIG. 4, there is a high likelihood that the two taut wire segments engaged by the intruder are not both anchored or monitored at the same post, because the intruder may not be aware of the location of sensors and anchor elements on the supporting post. The intruder may not be able to distinguish between the sensors and anchor elements since both can be made to have the same appearance. Further, the sensors and anchor elements can be hidden from an intruder by using a cover on the supporting posts. When an intruder cuts taut wires, the likelihood that two different sensors are monitoring the two wires is high, especially when using an alternating arrangement such as that of FIG. 4.

When two taut wire segments, monitored by sensors on different supporting posts, are engaged, two sensor posts will communicate an alarm condition instead of the single sensor post of a typical systems. The intrusion location can then be precisely identified as the area between the two supporting posts. Narrowing down the possible zone of intrusion may reduce the response time taken in isolating the cause of an alarm, thereby providing a higher level of performance. The cost of the system need not be increased significantly, if at all, despite the increase in accuracy of detection.

The arrangement of the sensors and anchor elements within the supporting posts of the system of FIG. 5 may be modified to prevent an intruder from scaling the fence by stepping over every other taut wire segment such that only the segments anchored at the supporting post are engaged. An alternating arrangements of groups of two sensors and two anchor elements can prevent the scaling of the fence by stepping on only the anchored taut wire segments. Other arrangements providing similar advantages can be used such as providing a non-uniform distribution of sensors and anchor elements such that a large group of sensors or a large group of anchor elements are provided at various locations on the supporting post.

Figure 6:
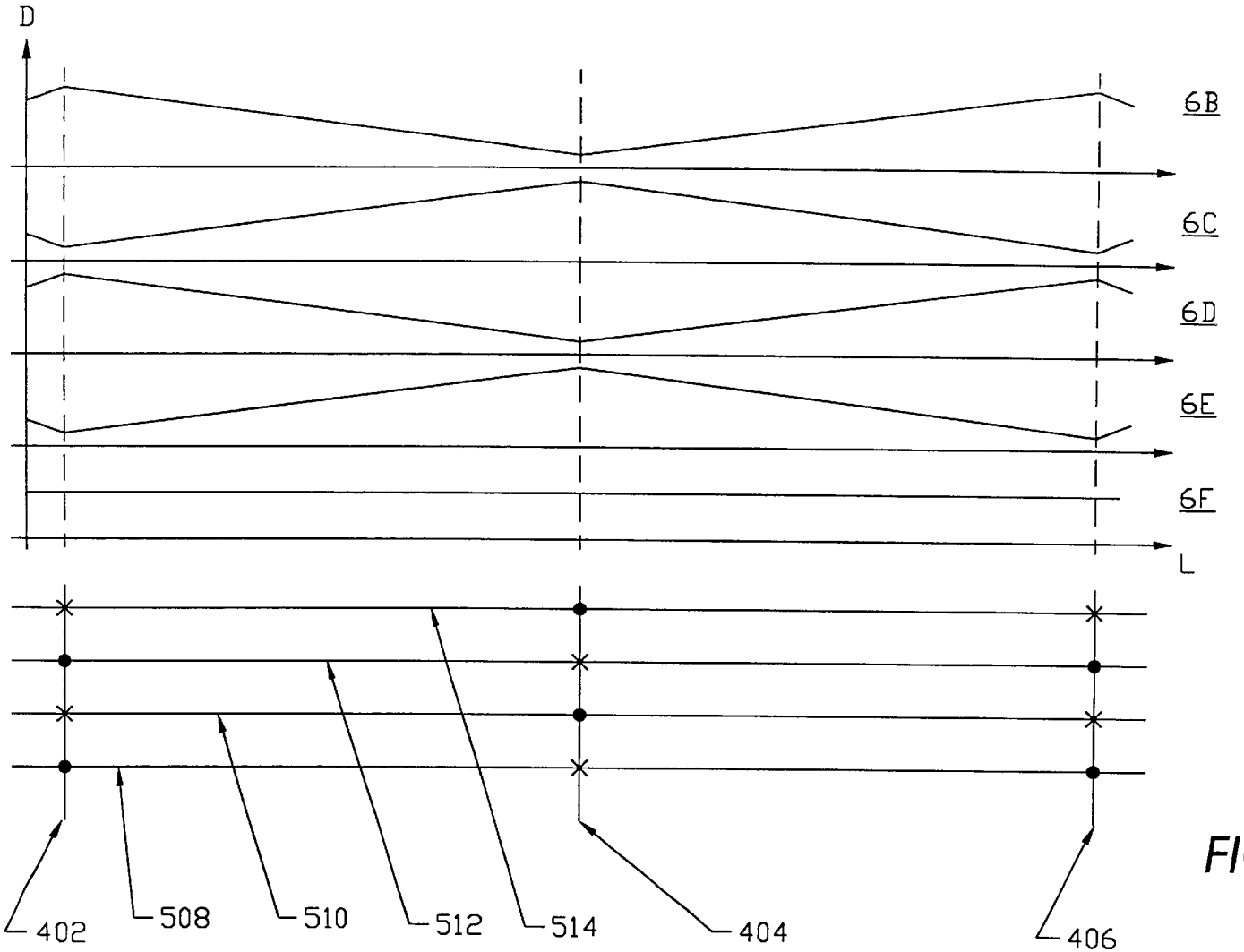
FIGS. 6A–6F illustrate the displacement requirement of a section of a system that includes the supporting posts of the present invention.

FIGS. 6A–6F illustrate the displacement requirement of taut wire segments of the system constructed in accordance with the present invention that is illustrated in FIG. 5. FIG. 6A is a simplified illustration of the system of FIG. 4, which includes three supporting posts 402, 404, 406. Taut wire segments 508, 510, 512, 514 are provided between the supporting posts as described with reference to FIG. 4. FIG. 5B illustrates the displacement requirement of a taut wire segment 514 over the distance between a first supporting post 402 and a third supporting post 406. Taut wire segment 514 is anchored at the first supporting post 402, connected to a sensor on the second supporting post 404, and anchored at the third supporting post 406. The displacement requirement of the taut wire segment 514 decreases as the contact point approaches the second supporting post 404 where it is monitored by a sensor. The displacement requirement of the taut wire segment 514 increases as the contact point moves away from the second supporting post 404 toward the first and third supporting posts 402, 406.

FIG. 6C illustrates the displacement requirement of a second taut wire segment 512 over the distance between the first supporting post 402 and the second supporting post 406. The taut wire segment 512 is connected to a sensor on the first supporting post 402, anchored at the second supporting post 404, and connected to a sensor on the third supporting post 406. The displacement requirement of the taut wire segment 512 increases as the contact point approaches the second supporting post 404 where it is anchored. The displacement requirement of the taut wire segment 512 decreases as the contact point moves away from the second supporting post 404 toward the first and third supporting posts 402, 406 where it is connected to sensors. The two other taut wire segments 508, 510 will behave similarly as is illustrated by FIGS. 6D and 6E. FIG. 6F illustrates the displacement requirement of the section over the distance between the first supporting post 402 and the third supporting post 406. As can be appreciated, the average displacement requirement at contact points along the section is substantially uniform. This uniformity of displacement requirement provides a taut wire intrusion detection system that can be adjusted without creating weak areas or high false alarm rates.

Figure 7:
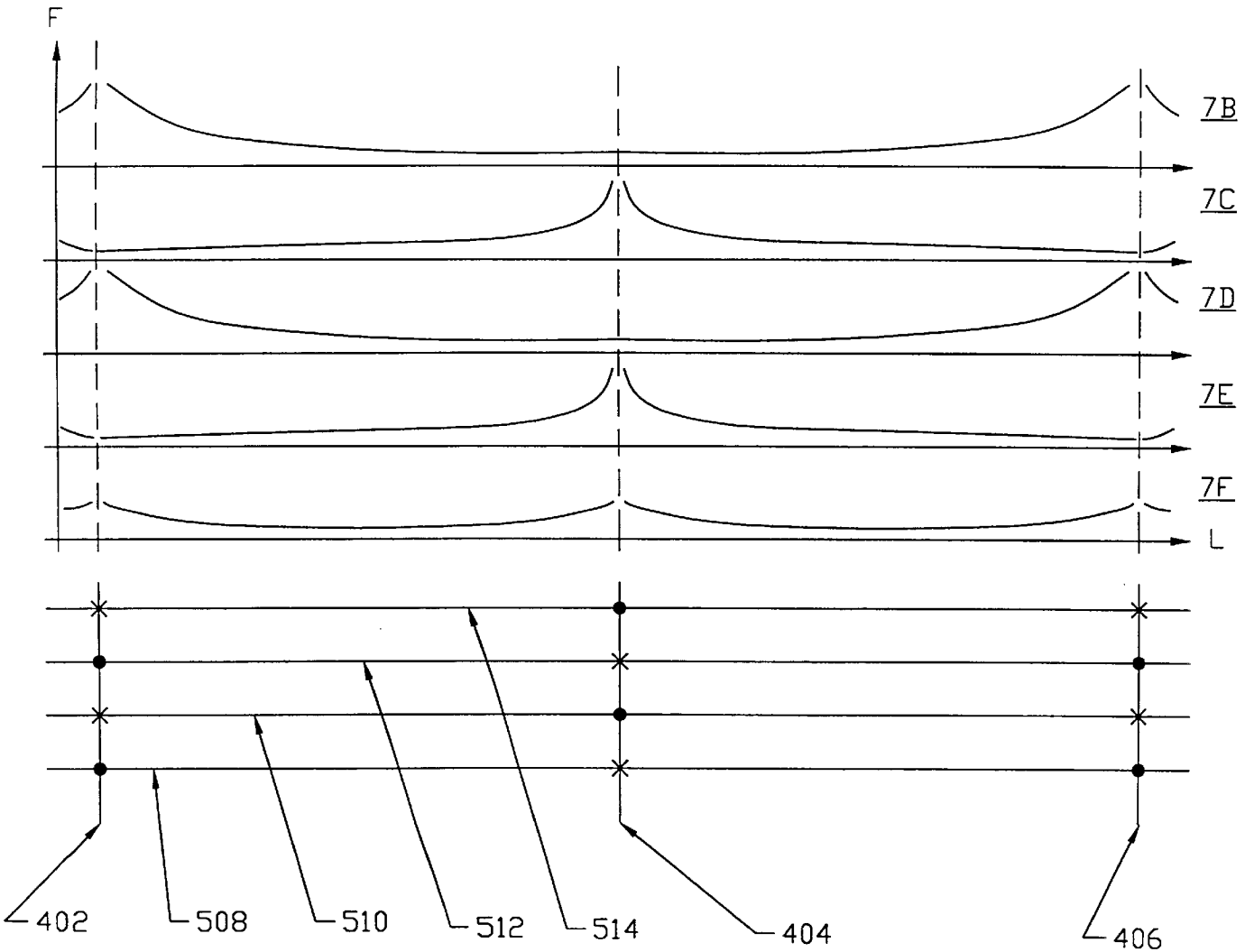
FIGS. 7A–7F illustrate the force requirement of a section of a system that includes the supporting posts of the present invention.

FIGS. 7A–7F illustrate the force requirement of the taut wire segments of the system illustrated in FIG. 5. FIG. 7A is the same illustration as that of FIG. 6A. FIG. 7B illustrates the force requirement of a taut wire segment 514 along the distance between a first supporting post 402 and a third supporting post 406. The taut wire segment 514 is anchored at the first supporting post 402, connected to a sensor on the second supporting post 404, and anchored at the third supporting post 406. The force requirement of the taut wire segment 514 decreases as the contact point approaches the second supporting post 404 where it is monitored by a sensor. The force requirement of the taut wire segment 514 increases as the contact point moves away from the second supporting post 404 toward the first and third supporting posts 402, 406.

FIG. 7C illustrates the force requirement of a second taut wire segment 512 along the distance between the first supporting post 402 and the third supporting post 406. The taut wire segment 512 is connected to a sensor on the first supporting post 402, anchored at the second supporting post 404, and connected to a sensor on the third supporting post 406. Taut wire segment 512 is anchored by anchor elements on supporting posts adjacent to the first and third supporting posts 402, 406. The force requirement of the taut wire segment 512 increases as the contact point approaches the second supporting post 404 where it is anchored. The force requirement of the taut wire segment 512 decreases as the contact point moves away from the second supporting post 404 toward the first and third supporting posts 402, 406 where it is connected to sensors. The two other taut wire segments 508, 510 will display a similar behavior as is illustrated by FIGS. 7D and 7E. FIG. 7F illustrates the force requirement of the section along the distance between the first supporting post 402 and the second supporting post 406. As can be appreciated, the force requirement at contact points along the portion that is illustrated is substantially uniform. This uniformity of force requirement provides a taut wire intrusion detection system that can be adjusted without creating loopholes in the system or increasing the rate of false alarms.

The present invention can be used to increase the distance between supporting posts of a taut wire system since no areas of the system are overly susceptible to intrusion. One factor substantially limiting the length of sectors in prior systems is the sensitivity variance of the system as discussed above. Since the present invention can be used to provide a more uniform sensitivity, sectors of the system can employ supporting posts that are further apart than sensor posts and anchor posts of prior systems. The use of longer sections would decrease the required number of supporting posts in the system. Therefore, the use of the method of the present invention can lead to a significant reduction in the cost of taut wire intrusion detection systems.

The present invention is also applicable to systems that employ no anchor elements. Since sensors are generally more sensitive when only one sensor monitors a taut wire segment at a time, systems that employ more than one sensor to monitor a single taut wire as to avoid the sensitivity variance will benefit from the method of the present invention. The sensors can be used while only one sensor monitors a taut wire segment to provide better detection capabilities while eliminating the sensitivity variance problem.

Although the invention has been described in terms of certain preferred embodiments, other embodiments that are apparent to those of ordinary skill in the art, including embodiments which do not provide all of the features and advantages set forth herein, are also within the scope of this invention. Accordingly, the scope of the invention is intended to be defined by the claims that follow.

What is claimed is:

1. A taut wire intrusion detection system, comprising:

a first support post which comprises at least one taut wire anchor element and at least one taut wire sensor;

a second support post which comprises at least one taut wire anchor element and at least one taut wire sensor;

a first taut wire segment which extends under tension between the first and second support posts, the first taut wire segment being anchored to the first support post by an anchor element thereof and being coupled to a taut wire sensor of the second support post; and a second taut wire segment which extends under tension between the first and second support posts such that the first and second taut wire segments are vertically separated from one another, the second taut wire segment being anchored to the second support post by an anchor element thereof and being coupled to a taut wire sensor of the first support post, wherein the taut wire is a double strand barbed wire, and wherein each sensor is used to monitor two taut wires.

2. The system of claim 1 wherein the sensor and anchor elements on the supporting post are arranged in an alternating arrangement.

3. The system of claim 1 wherein each sensor is used to monitor a single taut wire.

4. The system of claim 1 wherein the sensor element of the supporting post is a electro-mechanical contact sensor.

5. The system of claim 1 wherein the sensor element of the supporting post is a fiber optic sensor.

6. The system of claim 1 wherein the sensor element of the supporting post is a piezoelectric sensor.

7. The system of claim 1 wherein the anchor element of the supporting post is a breakaway tab.

8. The system of claim 1 wherein the taut wire system comprises at least eight taut wire segments.

9. The system of claim 1 wherein one continuous taut wire segment is provided through at least three anchor elements.

10. The system of claim 1 wherein two configurations of supporting posts are used, the first configuration including the same amount of sensor elements and anchor elements as the second configuration.

11. The system of claim 1 wherein anchor posts, comprising anchor elements are used to provide a termination function for a section of the system.

12. The system of claim 1 wherein a taut wire segment passing through two adjacent supporting posts can have one of two configurations: (1) anchored on the first supporting post and attached to a sensor on the second supporting post or (2) attached to a sensor on the first supporting post and anchored on the second supporting post.

* * * * *